US006780086B2

(12) United States Patent
Fortin et al.

(10) Patent No.: US 6,780,086 B2
(45) Date of Patent: Aug. 24, 2004

(54) DETERMINING AN ENDPOINT IN A POLISHING PROCESS

(75) Inventors: Vincent Fortin, Santa Clara, CA (US); Kuo-Chun Wu, San Jose, CA (US)

(73) Assignee: Mosel Vitelic, Inc., Hsin Chu (TW)

( * ) Notice: Subject to any disclaimer, the term of this patent is extended or adjusted under 35 U.S.C. 154(b) by 272 days.

(21) Appl. No.: 09/976,331

(22) Filed: Oct. 12, 2001

(65) Prior Publication Data

US 2003/0082996 A1 May 1, 2003

(51) Int. Cl.[7] ..... B24B 49/00
(52) U.S. Cl. ..... 451/8; 451/41
(58) Field of Search ..... 451/8, 5, 10, 288, 451/287, 41

(56) References Cited

U.S. PATENT DOCUMENTS

| | | | | |
|---|---|---|---|---|
| 5,036,015 A | * | 7/1991 | Sandhu et al. | 437/8 |
| 5,069,002 A | * | 12/1991 | Sandhu et al. | 451/5 |
| 5,308,438 A | * | 5/1994 | Cote et al. | 156/636 |
| 5,639,388 A | * | 6/1997 | Kimura et al. | 216/84 |
| 5,654,235 A | | 8/1997 | Matsumoto et al. | 438/643 |
| 5,976,327 A | | 11/1999 | Tanaka | 204/192.15 |
| 6,007,405 A | | 12/1999 | Mei | 451/5 |
| 6,012,970 A | | 1/2000 | Nagabushnam et al. | 451/41 |
| 6,071,572 A | | 6/2000 | Mosely et al. | 427/570 |
| 6,107,192 A | | 8/2000 | Subrahmanyan et al. | 438/637 |
| 6,121,134 A | | 9/2000 | Burton et al. | 438/652 |
| 6,143,140 A | | 11/2000 | Wang et al. | 204/192.12 |
| 6,156,647 A | | 12/2000 | Hogan | 438/653 |
| 6,176,981 B1 | | 1/2001 | Hong et al. | 204/192.15 |
| 6,264,812 B1 | | 7/2001 | Raaijmakers et al. | 204/298.06 |
| 6,494,765 B2 | * | 12/2002 | Gitis et al. | 451/5 |
| 6,547,637 B1 | * | 4/2003 | Zhang | 451/5 |

OTHER PUBLICATIONS

Warnock, J. D., IBM Tecnical Disclosure Bulletin, vol. 13, No. 4, pp. 325–326, (Sep. 1988).*

Chin, Barry L. et al., "Barrier and Seed Technologies for Sub–0–10 $\mu$m Copper Chips" May 2001, Cahners Semiconductor International, pp. 1–7.

"Handbook of Semiconductor Manufacturing Technology" (edited by Yoshio Nishi et al., 2000), pp. 395–413.

W. Wolf, "Silicon Processing for the VLSI Era", vol. 2—Process Integration (1990), pp. 245–247.

* cited by examiner

*Primary Examiner*—Robert A. Rose
(74) *Attorney, Agent, or Firm*—MacPherson Kwok Chen & Heid LLP

(57) ABSTRACT

In a polishing process (e.g. CMP), the endpoint is declared after (a) detecting that the friction between the polishing tool and the structure being polished is rising, then (b) determining that the friction is falling, then (c) waiting for a predetermined period of time (which can be zero). This algorithm results in reduced over-polishing in some embodiments. Other embodiments are also described.

27 Claims, 5 Drawing Sheets

DETERMINING AN ENDPOINT IN A POLISHING PROCESS

BACKGROUND OF THE INVENTION

The present invention relates to endpoint detection in a polishing process, and more particularly to endpoint detection based on friction between the polishing tool and the structure being polished.

Chemical mechanical polishing (CMP) is widely used in fabrication of integrated circuits. FIGS. 1 and 2 illustrate fabrication of tungsten plugs 120 that provide electrical contact between a layer 130 and another, overlying layer (not shown). Layer 130 can be a metal layer (e.g. tungsten) formed over a monocrystalline silicon substrate 140 and, possibly, over some other layer or layers 150. Silicon dioxide 160 is formed over layer 130. Openings 170 are etched in oxide 160 to expose metal 130. A thin titanium nitride layer 110 is deposited (e.g. sputtered) over the structure to promote adhesion (tungsten 120 does not adhere well to silicon dioxide). Then tungsten 120 is deposited by chemical vapor deposition to fill the openings 170 and cover the structure. The top surface of the structure is polished by CMP until tungsten 120 and titanium nitride 110 are removed from the top surface. The resulting structure is shown in FIG. 2. Another conductive layer (not shown) can be formed on this structure. This layer will electrically contact the layer 130 through the metal plugs 120/110 in openings 170. (For brevity, we will refer to plugs 120/110 as tungsten plugs 120.)

The CMP process should remove all of the tungsten 120 and titanium nitride 110 from the top surface of oxide 160 in order to avoid electrical shorts and excessive current leakage between the plugs. The CMP endpoint can be determined by monitoring the friction between the wafer and a polishing pad of the CMP tool. FIG. 3 illustrates an example CMP tool available from SpeedFam-IPEC of Chandler, Ariz. Wafer 180, which incorporates the structure of FIG. 1, is held upside down on a carrier 210 (the wafer's front side 180F faces down). A motor (not shown) rotates the carrier 210, thus causing the wafer to rotate. Another motor 212 rotates a polishing pad 220 which polishes the wafer. (The motor rotates a platen on the pad is positioned). Friction sensor 230 detects the friction between pad 220 and wafer 180 by detecting the current drawn by motor 212. Controller 240 stops the polishing process based on the friction data from sensor 230. Suitable controllers 240 and sensors 230 are available from LUXTRON Corporation of Santa Clara, Calif.

FIG. 4 is a chart showing the friction data FR produced by sensor 230. FR is shown as a function of time. Initially, signal FR decreases as tungsten 120 and titanium nitride 110 are being polished. At some time t1, signal FR levels off, indicating that the polishing pad has reached the oxide 160. Software programmable controller 240 (FIG. 3) is programmed to stop the CMP when the signal FR levels off.

FIG. 5 shows signal FR for another CMP process. In this example, layer 110 is titanium. At some time t2, the friction FR starts to rise. Then FR falls (starting at some time t3), and then levels off at a time t1 when the oxide 160 is reached. Controller 240 is programmed to perform the following steps, in the order shown:

1. Detect rising friction.
2. Detect falling friction.
3. Detect the friction leveling off, and declare an endpoint to stop the CMP.

SUMMARY

The inventors have observed that the endpoint detection method described above (stopping the CMP when FR levels off) results in excessive over-polishing. Too much of oxide 160 gets polished off. In some embodiments of the present invention, the CMP is stopped before FR levels off. In the example of FIG. 6, the friction signal FR is as in FIG. 5. The CMP is stopped a predetermined time "dt" after the time t3 (the time when FR starts falling off). Controller 240 is programmed to:

1. Detect rising friction.
2. Detect when the friction starts to fall.
3. Declare an endpoint the predetermined time dt after the friction starts to fall.

Step 1 (detect rising friction) assumes that at some point of time the signal FR is rising. In FIG. 4 (the titanium nitride case), the signal FR does not rise. In some embodiments, the titanium nitride deposition parameters are chosen so that the friction signal FR rises at some point (as in FIG. 5).

Other features of the invention are described below. The invention is defined by the appended claims.

DESCRIPTION OF PREFERRED EMBODIMENTS

Figure 6:
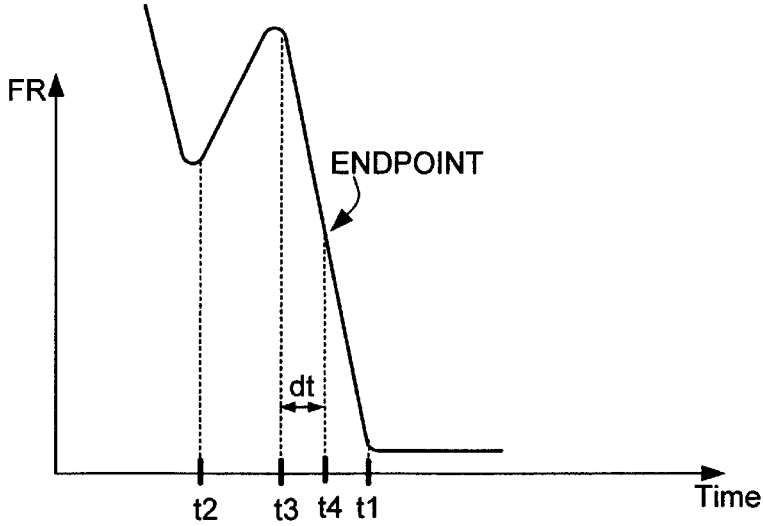
FIGS. 6, 7A, 7B, 7C, 8, 9, 10, 11 are charts illustrating endpoint detection in some embodiments of the present invention.

In the embodiment of FIG. 6, controller 240 is programmed to perform the following steps, in the order shown:

TABLE 1

| | |
|---|---|
| Step 1 | Detect rising friction (the rising friction is detected at time t2) |
| Step 2 | Detect falling friction (the falling friction is detected at time t3) |
| Step 3 | Wait for a predetermined time period dt (dt = 15 seconds in one embodiment). This period expires at a time t4. |
| Step 4 | Declare an endpoint (stop the CMP at t4). |

Controller 240 marks the conclusion of each step by suitable signals, as will be understood by those skilled in the art.

The appropriate value for the parameter dt can be found through experimentation, and may depend on the materials, the deposition parameters, the polishing technology, and perhaps other factors. Parameter dt is chosen to avoid under-polishing while minimizing the over-polishing. In some embodiments, dt=0. Step 3 may be omitted.

Detection of the rising and falling friction (Steps 1, 2) is performed with a precision that depends on the particular tool. Absolute precision may be impossible to achieve. Further, the absolute precision may provide a meaningless result due to noise causing the signal FR to oscillate.

In some embodiments, the rising or falling signal FR is validated for some time before the Step 1 or 2 is completed, i.e. before the rising or falling slope is signaled as detected.

In some embodiments, the rising signal is FR detected when the slope of the signal is larger than some small positive value, and the falling slope is detected when the slope is more negative than some small negative value. Small positive and negative slope values are treated as zero.

Figure 7A:
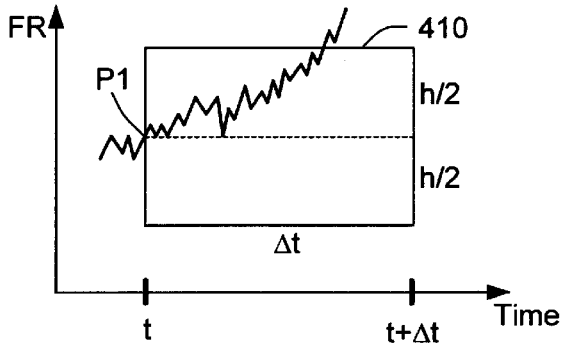

In some embodiments, the rising and falling slopes are detected using a software system of type OptiView 9300 available from LUXTRON Corporation. In that system, the slope of the signal FR at any time t is analyzed using a rectangular window 410 (FIG. 7A). The window is defined by two programmable parameters: (1) width Δt, and (2) half-height h/2. The sides of window 410 are parallel to the coordinate axes "Time", "FR". The window is positioned so that the signal FR enters the window at the time t at a point P located in the middle of the window's left boundary. If the signal FR exits the window by piercing the upper boundary (as in FIG. 7A), the OptiView system indicates that the signal FR is rising, i.e. the slope is positive. The window 410 is called an Up window in this case.

Figure 7B:
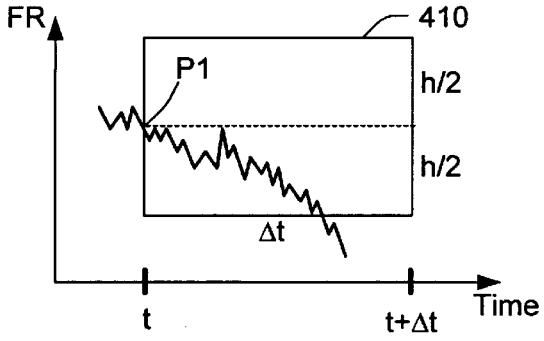

In FIG. 7B, the signal FR exits the window 410 by piercing its lower boundary. The OptiView system indicates that the signal FR is falling. Window 410 is called a Down window.

Figure 7C:
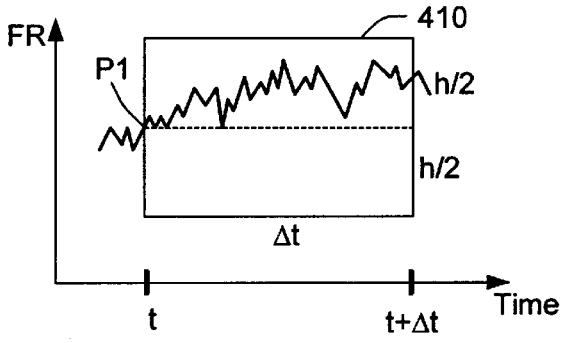

In FIG. 7C, the signal FR exits the window 410 by piercing its right boundary. The system indicates that the signal FR is neither rising nor falling. Window 410 is called a Side window.

Figure 8:
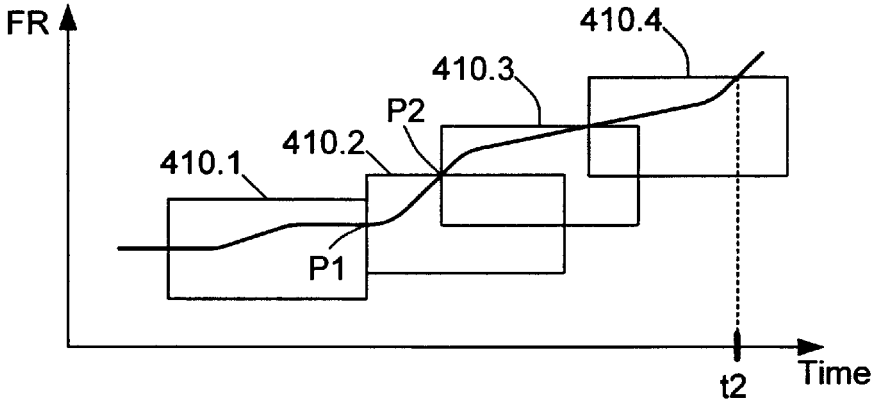

At Step 1 of Table 1 above, the rising signal may be validated for some predetermined, programmable number of windows before the rising signal is detected. FIG. 8 illustrates an example of a rising signal validated with three Up windows 410.2, 410.3, 410.4 which follow a Side window 410.1. Each subsequent window begins where the signal FR leaves the previous window. For example, the signal leaves the window 410.1 at a point P1. The window 410.2 is defined so that the middle of its left boundary is at the point P1. The signal leaves the window 410.2 at a point P2. The window 410.3 is defined so that the middle of its left boundary is at the point P2.

Similarly, at Step 2 of Table 1, the falling slope may be validated for some predetermined number of Down windows. Step 2 completes when the signal has been validated.

Figure 9:
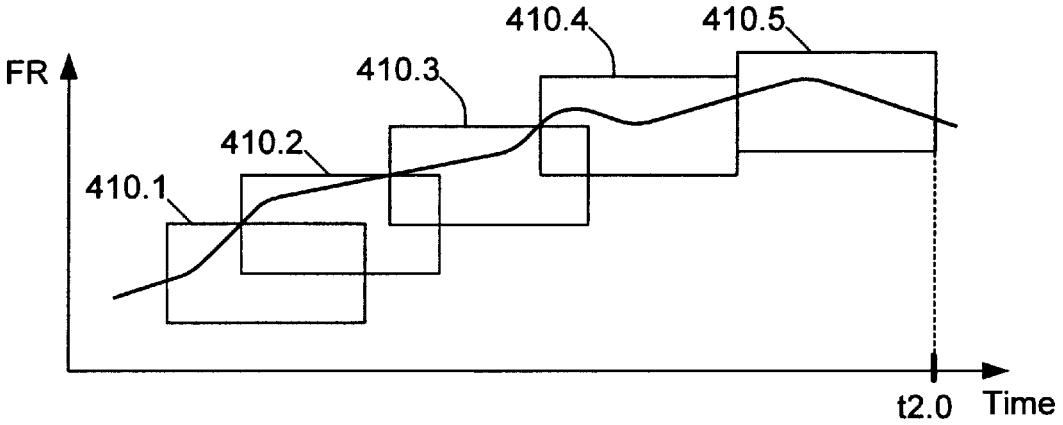

There are several ways to program controller 240 with the OptiView system to perform the steps of Table 1. In the embodiment of FIG. 8, Step 1 is performed in "Slope Start" mode, i.e. the rising friction is detected at t2 immediately upon the occurrence of a predetermined number of Up windows. In FIG. 9, Step 1 is performed in "Slope End" mode. The rising slope is detected upon the occurrence of a predetermined, programmable number of Up windows (windows 410.1, 410.2, 410.3) immediately followed by a predetermined, programmable number of Side windows (windows 410.4, 410.5). Step 1 is completed at some time t2.0 shortly before t3.

Figure 10:
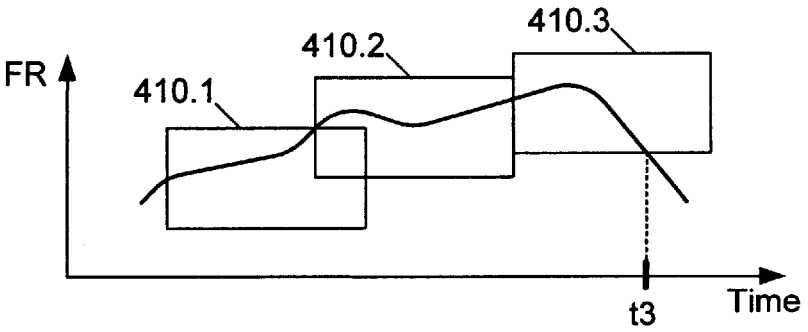

In FIG. 10, Steps 1 and 2 are combined by programming the controller 240 to detect a peak of signal FR. A peak is defined as an Up window (410.1 in FIG. 10) immediately followed by zero, one or two consecutive side windows (window 410.2), immediately followed by a Down window (window 410.3). In other embodiments, more than two consecutive Side windows are required. Also, more than one Up window and more than one Down window may be required.

In another embodiment, Step 1 is performed by programming the controller 240 to detect a valley (defined as a Down window, immediately followed by zero, one or two consecutive Side windows, immediately followed by an Up window). Step 2 is performed by programming the controller to detect either a falling slope in Slope Start mode or a peak. The invention is not limited to any particular programming. The invention is not limited to the OptiView 9300 system or a system using windows or having any particular programming features. Other systems, known or to be invented, can also be used.

Figure 11:
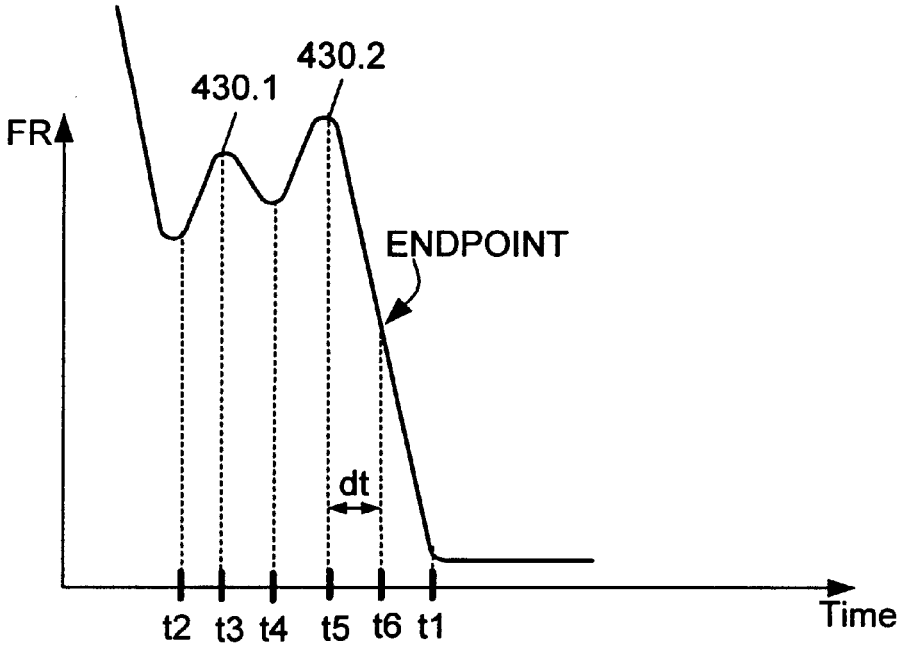

FIG. 11 illustrates another signal FR obtained in some embodiments. This signal has two peaks 430.1, 430.2. This signal FR can be obtained with layer 110 consisting of two titanium layers deposited by different techniques to have different friction characteristics. Layer 120 can be tungsten. Signal FR begins to rise at some time t2, when the top titanium layer is reached. Then FR begins to fall at some time t3. This provides the peak 430.1. Then FR rises again, starting at some time t4, possibly due to the bottom titanium layer. While the above explanation of the shape of signal FR is believed to be true, the invention does not rely the correctness of this explanation.

In some embodiments of FIG. 11, controller 240 is programmed as follows:

TABLE 2

| | |
|---|---|
| Step 1 | Detect rising friction (the rising friction is detected at t2) |
| Step 2 | Detect falling friction (the falling friction is detected at t3) |
| Step 3 | Detect rising friction (the rising friction is detected at t4) |
| Step 4 | Detect falling friction (the falling friction is detected at t5) |
| Step 5 | Wait for a predetermined period dt (e.g. 15 seconds). This period expires at a time t6. |
| Step 6 | Declare endpoint (stop the CMP at t6). |

These steps are performed in the order shown. The time dt may be zero. Step 5 may be omitted.

The invention is not limited to any number of peaks 430 or titanium layers in layer 110. Non-titanium layers can also be used. Different sub-layers of layer 110 may have different chemical composition.

Figure 4:
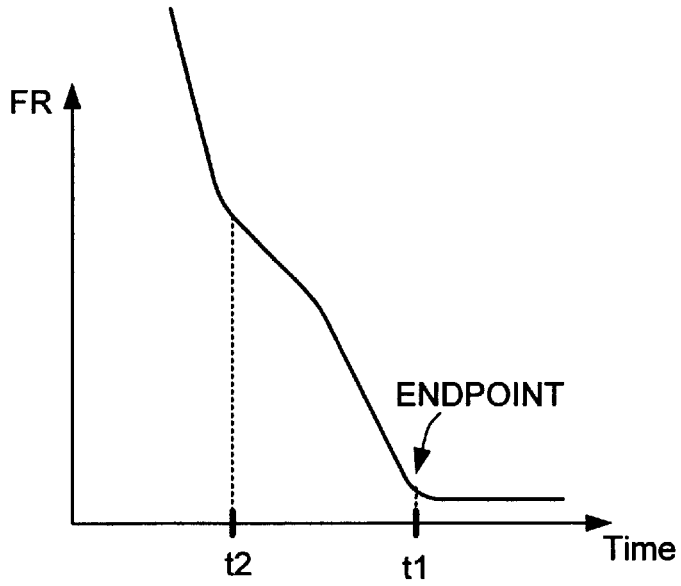
FIG. 4 PRIOR ART
FIGS. 4, 5 are charts illustrating prior art CMP endpoint detection.
Figure 5:
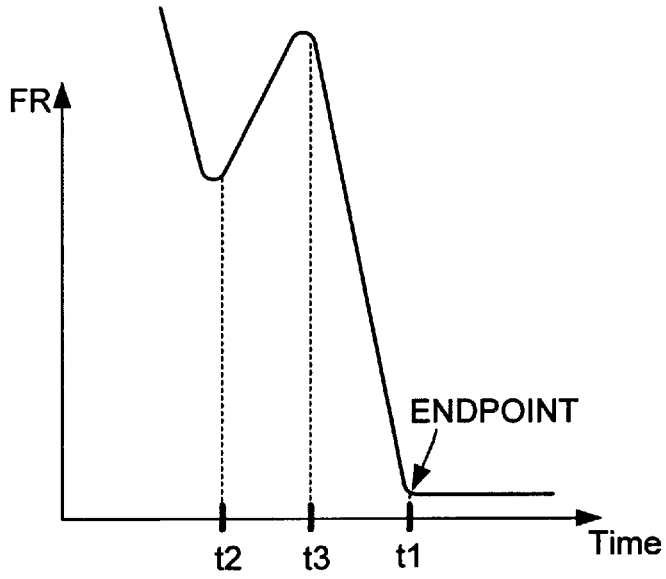
FIG. 5 PRIOR ART
Figure 12:
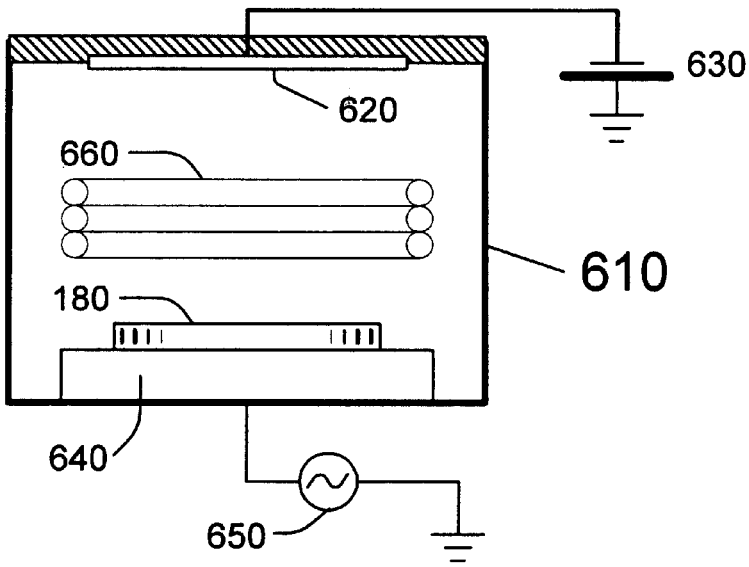
FIG. 12 PRIOR ART
FIG. 12 is a side cross-sectional view of an ionized metal plasma deposition chamber.

In FIG. 4, layer 110 is titanium nitride. The friction FR does not rise. FR can be made to rise by a suitable choice of the titanium nitride deposition process. In some embodiments, the titanium nitride is deposited by an ionized metal plasma process (IMP) also known as ionized physical vapor deposition (ionized PVD). FIG. 12 illustrates a suitable deposition chamber 610. Chamber 610 is a magnetron IMP chamber of type Vectra available as part of a system of type ENDURA from Applied Materials of Santa Clara, Calif. Titanium target 620 is mounted at the top of chamber 610. Target 620 is connected to a negative DC bias source 630. Wafer 180 is placed on a pedestal 640 whose top surface is made of a dielectric material. RF (radio frequency) bias source 650 biases the pedestal with an AC current of a frequency 13.56 MHz. Argon is flown into the chamber. Bias source 630 helps ionize the argon. Coil 660 generates an RF electromagnetic field to densify the argon plasma, making the plasma high density. The argon ions dislodge titanium atoms from target 620. Nitrogen flown into the chamber reacts with the titanium atoms to form titanium nitride. Some of the titanium nitride molecules become ionized by the high density plasma. The titanium nitride atoms and ions are deposited on wafer 180. See "Handbook of Semiconductor Manufacturing Technology" (edited by Yoshio Nishi et al., 2000), pages 395–413, incorporated herein by reference.

In some embodiments, the titanium nitride deposition parameters are:

TABLE 3

| | |
|---|---|
| Base pressure in chamber 610 (the pressure before the nitrogen flow is turned on) | $5 \times 10^{-7}$ torr. |
| Nitrogen flow | 28 sccm (standard cubic centimeters per minute). |
| Argon flow | 25 sccm. |
| DC power (source 630) | 4000 W. |
| RF power (coil 660) | between 2000 W and 2500 W inclusive (to provide a high TiN density). |
| Wafer pedestal bias (source 650) | greater than 150 W (500 W in some embodiments). |
| Deposition temperature | 200° C. |

TiN layer 110 is deposited to a thickness of 8 nm or more.

Then tungsten 120 is deposited by chemical vapor deposition (CVD) as described, for example, in U.S. patent application Ser. No. 09/881,607 filed Jun. 13, 2001 by V. Fortin, entitled "Thin Titanium Nitride Layers Used in Conjunction with Tungsten", incorporated herein by reference. See also S. Wolf, "Silicon Processing for the VLSI Era", Volume 2—Process Integration (1990), pages 245–247, incorporated herein by reference. The tungsten thickness is at least 350 nm in some embodiments.

Then the CMP is performed. The friction signal FR is shaped as in FIG. 6. (FIG. 6 does not show an initial signal stabilization period which can be programmed to be a few seconds, e.g. 30 seconds.) The time t2 is believed to correspond to the polishing tool reaching the titanium nitride. The time t3 may be the time when most or all of the titanium nitride has been polished off. The invention does not depend on the correctness of this explanation for the times t2, t3.

Controller 240 can be programmed as in Table 1. In one experiment using an OptiView 9300 system, the controller 240 was programmed as follows:

TABLE 4

| | |
|---|---|
| Step 1 | Detect rising friction in Slope Start mode. |
| Step 2 | Detect falling friction in Slope Start mode. |
| Step 3 | Wait for dt = 15 seconds. |
| Step 4 | Declare an endpoint when dt expires. |

These steps were performed with windows 410 having the following dimensions (see FIGS. 7A, 7B, 7C):

Width $\Delta t$=1.5 seconds.

Half-height h/2=5% of the full signal amplitude. The full signal amplitude was about 200.

Figure 3:
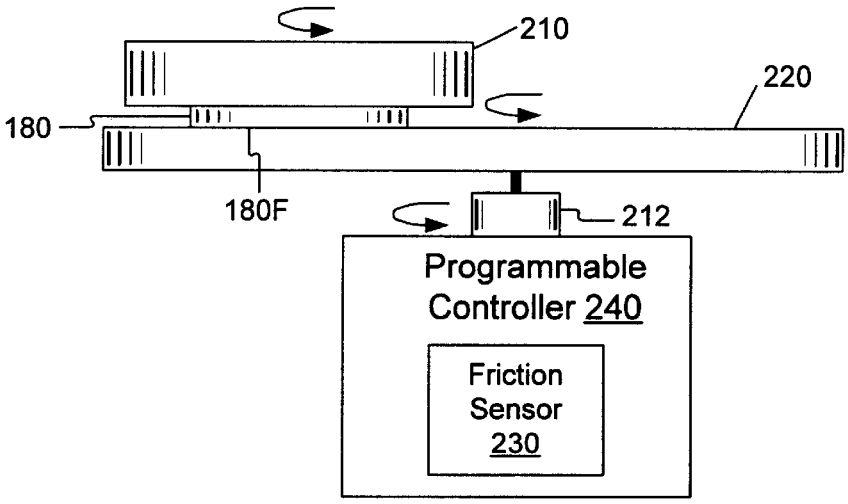
FIG. 3 PRIOR ART
FIG. 3 is a side view of a CMP tool.

The CMP equipment was as described above for FIG. 3. Polishing pad 220 was a stacked pad of type IC1000/SubaIV available from Rodel, Inc. The polishing slurry was Semi-Sperse® W2585 available from Cabot Microelectronics Corporation, Aurora, Ill.

At Step 1, the rising friction was validated for three windows. At Step 2, the falling friction was validated for three windows.

This process was compared with another process in which the CMP was stopped at time t1 (FIG. 6). In both cases, TiN 110 was formed as in Table 3, and tungsten 120 was formed by CVD. In the case of Table 4, the CMP removed 25–30 nm less of silicon dioxide 160 than when the CMP was stopped at time t1. Yet the process of Table 4 removed all of TiN 110 from the top of oxide 160.

The invention is not limited to any particular TiN thickness values or deposition parameters. In the case of Table 3, the thickness can be 20 nm or some other value. Thicker TiN layers are believed to increase the time interval between t2 and t3. The choice of the deposition parameters needed to obtain a rising friction FR may depend on the polishing tool and, in particular, on the controller 240 endpoint detection mechanism.

In a variation of the process of Table 3, the titanium nitride deposition with a wafer pedestal bias of 500 W is preceded by a titanium nitride deposition at a lower bias, for example, 150 W or 0 W. For example, a 12 nm layer of TiN is deposited at 0 W, then a TiN layer having a thickness of 8 nm or more of is deposited at 500 W. The initial low-bias deposition is performed to protect silicon dioxide 160 from high energy TiN ions generated during the 500 W deposition. The high energy TiN ions can dislodge the silicon dioxide atoms, and the dislodged atoms can settle in openings 170 and increase the contact resistance. See U.S. patent application attorney docket no. M-11989 US filed by V. Fortin on the same date as the present application, entitled "Forming Conductive Layers On Insulators By Physical Vapor Deposition", incorporated herein by reference.

Without limiting the invention to any particular theory, the high pedestal bias is believed to provide a TiN layer with a high surface roughness and a low density compared to a lower bias. The high surface roughness is believed to increase the friction between the TiN layer and the CMP pad. In one experiment, the TiN surface roughness was measured with an AFM (atomic force microscopy) tool. TiN was deposited to a 30 nm thickness in a Vectra chamber of FIG. 12. Oxide 160 had been deposited from TEOS to a 700 nm thickness. The surface roughness RMS (root mean square) value was 1.121 nm for TiN layer deposited with the pedestal bias of 500 W. The RMS was 0.685 nm for the pedestal bias of 150 W.

Figure 1:
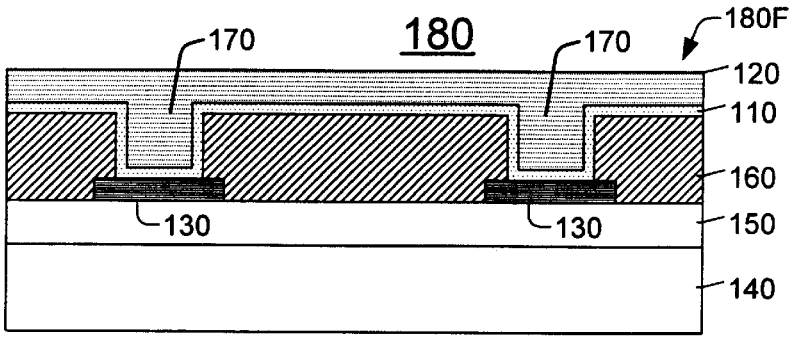
FIG. 1 PRIOR ART
FIGS. 1 and 2 are cross section illustrations of an integrated circuit in the process of fabrication.
Figure 2:
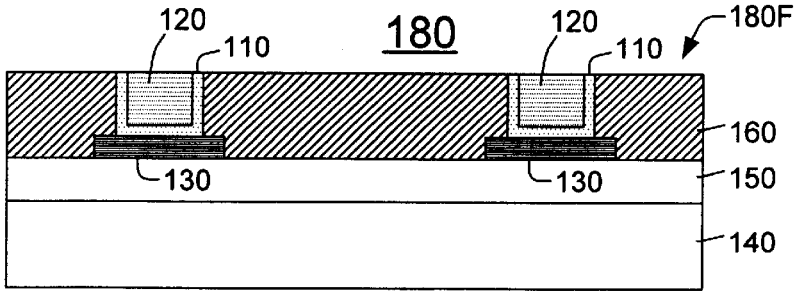
FIG. 2 PRIOR ART

The invention is not limited to any particular layer thicknesses, frequency values or other deposition parameters, or to particular equipment. In some embodiments, the low-bias TiN deposition (e.g. at 0 or 150 W) is replaced, or used in conjunction with, deposition of some other layer protecting the silicon dioxide. In some embodiments, the high-bias deposition (e.g. at 500 W) is immediately followed by a lower bias TiN deposition. The RF bias from source 650 can be applied directly to wafer 180, and can be replaced with a DC bias. Non-silicon dioxide insulators can be used for layer 160. The invention is not limited to the chamber of FIG. 12 or to PVD. The invention is not limited to any particular materials. For example, layer 120 can be copper, and layer 110 can be tantalum nitride. Other conductive materials for layers 110, 120 can be used. Layer 130 can be a non-tungsten layer. The invention is not limited to the contact structures of FIGS. 1, 2. The invention can be used to form damascene interconnect structures and other structures, known or to be invented. Substrate 140 can be a non-silicon substrate.

Friction data FR can be measured as a current drawn by a motor rotating the carrier 220. The invention is not limited to the friction data being measured as a current drawn by a motor, or to any other way of getting a signal representative of the friction between the wafer and the CMP tool. In some embodiments, the signal FR is an inverse of the friction. FR falls when the friction rises, and vice versa. Detecting a rising friction is performed by the controller detecting a falling signal FR, and vice versa. In other embodiments, FR is some other function of the friction. The invention is not limited to any particular timing or slope parameters in the CMP endpoint detection, to the tool of FIG. 3, or to software programmable controllers. Non-chemical polishing can be used. Other embodiments and variations are within the scope of the invention, as defined by the appended claims.

What is claimed is:

1. A manufacturing method comprising:

(a) polishing a structure comprising a substrate and at least a first layer disposed above the substrate, to thereby remove at least a portion of the first layer;

(b) determining and declaring an endpoint for the polishing operation based on friction present between the structure and a polishing tool used for performing the polishing;

(c) stopping said polishing upon said declaring of the endpoint;

wherein said determining and declaring of the endpoint includes the following machine-implemented operations:

(b.1) first detecting that the friction has a friction versus time waveform with a first average slope indicating that the friction is steadily rising, (b.2) second detecting, after said first detecting, that the friction versus time waveform has a second average slope indicating that the friction is steadily falling; and (b.3) wherein said declaring of the endpoint occurs immediately after said second detecting or a predetermined amount of time after said second detecting.

2. The method of claim 1 wherein said determining and declaring of the endpoint further includes the following machine-implemented operation:

(b.4) carrying out a third detecting between said second detecting that the friction is falling and said first detecting that the friction is rising, where the third detecting comprises detecting that the friction versus time waveform has a relatively flattened section indicating that the friction is neither steadily rising nor steadily falling for at least a predefined time period before the second detecting indicates the friction is steadily falling.

3. The method of claim 1 wherein the machine-implemented operations of said first and second detectings are performed by a programmable circuit that is programmed to detect a local maxima of the friction versus time waveform.

4. The method of claim 1 wherein said determining and declaring of the endpoint further includes the following machine-implemented operations:

(b.4) carrying out a third detecting between said first and second detectings, where the third detecting detects that that the friction versus time waveform has a third average slope indicating that the friction is steadily falling; and (b.5) carrying out a fourth detecting between said third and second detectings, where the fourth detecting detects that that the friction versus time waveform has a fourth average slope indicating that the friction is steadily rising before the second detecting indicates the friction is steadily falling.

5. The method of claim 1 wherein the substrate comprises an insulating layer, and the polishing continues until the insulating layer is exposed.

6. The method of claim 5 wherein the first layer comprises a first sub-layer formed on the insulating layer and a second sub-layer formed over the first sub-layer, wherein the first and second sub-layers have a substantially similar chemical compositions but at least one of respective, different densities and different surface roughnesses.

7. The method of claim 6 wherein the second sub-layer has a lower density and a higher surface roughness than the first sub-layer.

8. The method of claim 6 wherein each of the first and second sub-layers respectively comprises titanium or titanium nitride.

9. The method of claim 5 wherein the first layer comprises: (1) a titanium nitride layer formed on the insulating layer, and (2) a conductive layer formed on the titanium nitride layer.

10. The method of claim 9 wherein the titanium nitride layer is formed by physical vapor deposition (PVD).

11. The method of claim 9 wherein at least a portion of the titanium nitride layer is formed by ionized PVD as the substrate is lying on a support biased with an AC bias of more than 150W.

12. The method of claim 11 wherein the AC bias is at least 200 W.

13. The method of claim 11 wherein the AC bias is at least 250 W.

14. The method of claim 11 wherein the AC bias is at least 400 W.

15. The method of claim 11 wherein the AC bias is 500 W.

16. The method of claim 11 wherein the titanium nitride layer has a thickness of at least 8 nm.

17. The method of claim 9 wherein the conductive layer comprises tungsten.

18. The method of claim 1 wherein the substrate has a surface and an opening defined in said surface, the first layer is formed on the surface of the substrate and extending into the opening, and during the polishing, material of the first layer is removed from the surface of the substrate but not from the opening.

19. A device for controlling a polishing process of polishing a structure comprising a substrate and a first layer formed on the substrate, the device comprising circuitry for determining and declaring an endpoint for the polishing operation based on a signal indicative of friction between a polishing surface and the structure;

wherein said circuitry for determining and declaring the endpoint comprises:

(a) first means for detecting that a magnitude versus time waveform of the friction indicating signal has successive first and second waveform sections indicating that the friction is first, on average rising, and second that the friction is on average falling; and (b) second means which is responsive to the first means and is programmable for declaring the endpoint immediately after the first means detects the second waveform section or a predetermined amount of time after the first means detects the second waveform section.

20. The control device of claim 19 wherein the first means is part of a programmable device that is programmed to perform said detecting of the successive first and second waveform sections.

21. A machine implemented method for halting chemical mechanical polishing (CMP) of a workpiece having a sequence of layers, where the layers exhibit different frictions relative to a utilized CMP tool, the method comprising:

(a) receiving a friction-indicative signal which is indicative of friction between the workpiece and the CMP tool;

(b) first detecting that the friction-indicative signal has a magnitude versus time waveform with a first section whose average slope over a corresponding first duration indicates that the friction is on average, rising during the first duration of that first section of the waveform;

(c) second detecting that the magnitude versus time waveform has a second section, following the first section, where the average slope of the second section over a corresponding second duration indicates that the friction is on average, falling for that second section of the waveform; and (d) in response to said first and second detectings, halting the chemical mechanical polishing a predetermined amount of time after said second detecting, where the predetermined amount of time is zero or greater than zero.

22. The machine implemented halting method of claim 21 wherein:

said sequence of layers includes a layer of comparatively high density and a layer of substantially lesser density.

23. The machine implemented halting method of claim 21 wherein:

said sequence of layers includes a layer having comparatively large surface roughness and a layer with a substantially smoother surface for presentation to the CMP tool.

24. The machine implemented halting method of claim 21 wherein:

(b.1) said first detecting is validated by a continuous succession of UP windows through which the first section of the waveform extends.

25. The machine implemented halting method of claim 24 wherein:

(c.1) said second detecting is validated by a continuous succession of DOWN windows through which the second section of the waveform extends.

26. The machine implemented halting method of claim 24 wherein:

said sequence of layers includes a titanium nitride layer.

27. The machine implemented halting method of claim 21 wherein:

(d.1) said predetermined amount of time is greater than zero but terminates before the friction-indicative signal flattens out after the second section of the waveform.

* * * * *

UNITED STATES PATENT AND TRADEMARK OFFICE

CERTIFICATE OF CORRECTION

PATENT NO. : 6,780,086 B2
DATED : August 24, 2004
INVENTOR(S) : Vincent Fortin and Kuo-Chun Wu It is certified that error appears in the above-identified patent and that said Letters Patent is hereby corrected as shown below:

Column 7,
Line 50, delete “that” second occurence.

Column 8,
Line 2, delete “comprises” and insert -- comprise --.

Signed and Sealed this

Twenty-sixth Day of July, 2005

JON W. DUDAS
*Director of the United States Patent and Trademark Office*